US005630753A

United States Patent [19]

Fuchs

[11] Patent Number: 5,630,753

[45] Date of Patent: May 20, 1997

[54] GAMING MACHINE

[75] Inventor: Anton Fuchs, Gross Sierning, Austria

[73] Assignee: Novo-Invest Casino Development Aktiengesellschaft, Gumpoldskirchen, Austria

[21] Appl. No.: 367,146

[22] PCT Filed: Jul. 9, 1993

[86] PCT No.: PCT/AT93/00117

§ 371 Date: Jan. 9, 1995

§ 102(e) Date: Jan. 9, 1995

[87] PCT Pub. No.: WO94/01840

PCT Pub. Date: Jan. 20, 1994

[30] Foreign Application Priority Data

Jul. 9, 1992 [AT] Austria ..... 1410/92

[51] Int. Cl.[6] ..... A63F 9/24

[52] U.S. Cl. ..... 463/9; 463/12; 463/13; 463/20

[58] Field of Search ..... 273/85 CP, 138 A, 273/292, 143 R; 364/412; 463/1, 9–13, 16, 20, 30–31, 36

[56] References Cited

U.S. PATENT DOCUMENTS

| | | | |
|---|---|---|---|
| 4,926,327 | 5/1990 | Sidley | 463/13 |
| 5,016,880 | 5/1991 | Berge | 273/138 A |
| 5,033,744 | 7/1991 | Bridgeman et al. | 364/412 |
| 5,046,735 | 9/1991 | Hamano et al. | 273/138 A |
| 5,127,651 | 7/1992 | Okada | 273/143 R |
| 5,263,716 | 11/1993 | Smyth | 273/138 A |
| 5,277,424 | 1/1994 | Willms | 463/12 |
| 5,294,120 | 3/1994 | Schultze | 463/13 |

FOREIGN PATENT DOCUMENTS

| | | |
|---|---|---|
| 3820865A1 | 12/1989 | Germany . |
| 2112984 | 7/1983 | United Kingdom . |
| 2117155 | 10/1983 | United Kingdom . |
| 2148036 | 5/1985 | United Kingdom . |
| 2165385 | 4/1986 | United Kingdom . |
| 2201821 | 9/1988 | United Kingdom . |

*Primary Examiner*—Jessica Harrison
*Assistant Examiner*—Marle A. Sager
*Attorney, Agent, or Firm*—Cohen, Pontani, Lieberman, Pavane; Christa Hildebrand

[57] ABSTRACT

The invention relates to a gaming machine with at least one display area (2) for a number of game symbols (3) which, after the player has pressed a start button (4) to start the game, are selected under the control of a computing unit (5) from a multitude of predetermined symbols and presented at positions in the display area (2) for the player to view. The invention calls for the gaming machine (1) to have, preferably in the display area (2), at least one chance-display zone (7, 7') in which the computing unit (5), optionally on actuation of a request unit (14), e.g., a request button, by the player, displays possible and/or increased and/or best-possible win chances, and/or instructions for determining them, which are available for the next game or which, on removal of one or more of the game symbols or game-symbol combinations presented for the next game, apply or could possibly be achieved in the next game.

14 Claims, 2 Drawing Sheets

GAMING MACHINE

BACKGROUND OF THE INVENTION

1. Field of the Invention

The invention relates to a gaming machine having at least one display field, in particular a screen, for a plurality of game symbols, e.g., playing card symbols, fruit machine symbols, or similar, wherein the player is presented with the game symbols after the game or a play (section of the game) is started, possibly by the player actuating a start key and/or inserting a coin, or after the expiry of a certain period of time, and said symbols appear at a predetermined number of positions in the display field under the control of a computer unit or microprocessor after they have been selected from a large number of predetermined or existing game symbols in accordance with randomizing criteria, or by implementing a computer program, or in accordance with arbitrarily given criteria, wherein especially a win is determined by, or is made dependent on, the position or location in the display field at which the game symbol appears or is presented, and/or by or on the type of selected or presented game symbols, and/or by or on the number of identical game symbols, and if appropriate a win is indicated on a win display, wherein the gaming machine possesses preferably at least one display area in the display field in which an attainable maximum win is indicated by the computer unit, possibly after the player actuates a call-up unit, e.g., a call-up button, wherein the player has the option of selecting and holding or storing none, one or a number of these indicated game symbols for the next game or the next section of the game, and in the next game or section of the game the player is offered by the computer unit, according to randomizing criteria or arbitrarily predetermined criteria, game symbols taken from the large number of predetermined or still available game symbols to replace the non-selected or non-stored game symbols, and in this next game or section of the game the win is made dependent in particular on the position and/or the type and/or the identicality of all the game symbols displayed at that time, wherein the display field, and in particular the display area, contains an additional winning chances display area in which, in particular to make it easier to implement various individual game strategies, and in addition to the game symbols corresponding to the maximum possible win, the computer unit also displays a number of other or all possible attainable win-related combinations of game symbols and/or information on for calculating the probabilities of winning, and the said combinations of game symbols are given or are perhaps attainable in the next game or the next section of the game, using the game symbols offered or available, or using the game symbols or combination of game symbols stored by the player or selected by him to be stored for the next game or the next section of the game.

2. Discussion of the Prior Art

German Patent Application A1 38 20 865 describes an entertainment device in which symbols taken from an existing combination of symbols must be added to other symbols in order to obtain a winning combination of symbols. Taking into account the game plan for winning, this device recommends to the player which symbols should be added to the held symbols, in order to obtain the largest possible win. At the same time, the player is given information on how easy it is to obtain these additional symbols, or he is informed of the period of time within which a control element must be actuated in order to obtain the desired symbol.

GB Patent Application A1 2,112,984 describes a gaming machine (fruit machine) with rotary elements bearing symbols which also incorporates a "nudging" feature. Once a game has been played on this machine, the stationary rotary elements displaying a certain combination of symbols can be indexed once more by nudging; the nudging function is made available to the player in accordance with randomizing criteria and it enables him, perhaps, to improve the result which he has obtained and thus win a prize. Descriptions of similar devices can also be found in GB A1 2,165,385 or 2,117,155.

U.S. Pat. No. 5,046,735 relates to a poker game machine which, after the first game is completed, suggests to the player certain game symbols that should be held for use in the next game; at the same time, the machine displays the maximum prize that might be won during the next game if the game symbols which the machine offers to hold are indeed held.

In all these known devices, the machine merely displays the maximum prize that can be won in the respective game being played. However, the probability of winning this maximum prize is extremely low; usually, there are a number of other chances of winning which enjoy a much higher probability of being realized. Certain game strategies are not helped by providing the player with information on the maximum prize; furthermore, no information whatever is provided on the chances of winning if the game symbols which the machine offers to store or hold are arbitrarily modified precisely because the player wishes to pursue a strategy other than that suggested by the gaming machine.

SUMMARY OF INVENTION

The purpose of the invention is to increase the attractiveness of gaming machines for the player, or to help the player to make use of what are, in his opinion, the optimal chances of winning out of all the chances which exist on the basis of the game programmed and/or of probability and/or of the number and/of the type of game symbols that are available or that can be displayed by the computer. The specific aim of the invention is to indicate to the player what are the best chances which he has of winning in a subsequent game, given the symbols or combinations of symbols which are displayed or which he has selected; alternatively the player can be given tips on how best to utilize his chances, even if these objectively available and displayable chances of winning are often at odds with the game strategy and the psychological reactions of the player, having regard to the displayed game symbols; by combining the actually existing chances of winning with a certain amount of "feel" on the part of the player, the latter should be able, with help from the gaming machine, to modify and perhaps improve his game situation and his prospects of winning against the machine; this actual or apparent improvement in the player's situation greatly enhances the attractiveness of the gaming machine.

In a gaming machine of the type referred to at the beginning, these goals are attained in the manner according to the invention by the features mentioned above.

In this way, the player can follow various game strategies and he can assess the attainable chances of winning as a function of various game symbols or combinations of such symbols which he has arbitrarily selected to be stored. Thus, the player is not only presented with a display of the maximum possible prize which he can win in the next game using the symbols which he has selected, but he is also shown all or at least a number of the chances of winning that exist if he uses those symbols.

After the first game or play, at the end of which the gaming machine displays to the player the result obtained on the basis of the game symbols presented in the display field, the gaming machine can either simultaneously with this display, or after a call-up button has been actuated, display the prizes that could be won in the next game using an individual symbol (e.g. a joker) or several (e.g. several identical symbols) of the displayed game symbols or combinations of symbols selected by the gaming machine. The player will choose his strategy on the basis of the chances which are displayed. Only in exceptional cases will the player be presented with just one opportunity of winning, namely when just one single win exists which is higher than that obtainable with the displayed combination of symbols; this would be the case, for example, when four identical card symbols (Poker) are presented; thus, in the next game or hand, the only way to obtain a higher win would be to aim for a display of five identical card symbols.

It is advantageous if the gaming machine operates in the manner wherein the maximum win and a number of other or all possible winning combinations of game symbols, or information regarding the probability of winning or how to determine such probability, can be called up or displayed, possibly by means of a call-up device at the touch of a button or automatically, as a function of game symbols selected by the player himself from the game symbols offered by the computer unit, especially after actuation of at least one of the selection means, e.g., hold keys, assigned to the individual game symbols appearing in the display field. This is, because in such an embodiment of the invention the player himself can determine the chances of winning or the maximum possible wins attainable with the game symbols which he finds attractive and which he is considering holding for the next game.

In accordance with the invention, the features whereby in a winning chances display area, as an aid to determining the chances of winning in the immediately following game or section of the game or the chances offered by a subsequent selection of symbols, the player may be shown all and/or an individual number and/or the type of symbols available or predetermined for the next game, or the symbols which may be presented by the computer unit in the next game. These features constitute an addition or an alternative to the above-mentioned displays of the chances of winning. The player can then judge the possibility whether a particular display of game symbols will actually appear. It is advantageous to proceed in such a manner that, especially after a certain number of games and/or after the presentation or the appearance of a certain number of game symbols, e.g. after the appearance of a joker, it is possible either to reset the entire and/or an individual number and/or the type of game symbols displayed, or a given total and/or individual number and/or type of game symbols can be added to the remaining not yet displayed game symbols; when this is done, the game symbols displayed or those selected by the player, especially the symbols selected for a next game or on which a win is based, will be eliminated from the large number of predetermined game symbols or from the respective still available set of game symbols and will no longer be offered in any subsequent games.

Finally, the invention also relates to a method supporting the game strategies of a player, or for increasing the attractiveness of a game or for optimizing the win when playing with a gaming machine having at least one display field for a number of game symbols, e.g., playing card symbols, fruit machine symbols and similar, wherein, after the game has been started by actuating a start button, the game symbols, which are selected from a large number of predetermined game symbols, are presented to the player at positions in the display area, in particular a screen or adjacently arranged rotary elements, under the control of a computer unit or a microprocessor, wherein a win is determined by or made dependent in particular on the position or location in the display field and/or by or on the type and/or by or on the number of identical game symbols appearing among the game symbols selected and presented in the display field, wherein the player has the option of selecting and storing none or one or a number of these displayed game symbols for the next game, wherein the player is given a display showing the maximum achievable win in the next game, wherein in the next game the computer unit offers the player new game symbols only at the positions of the game symbols which were not selected or not stored or not held, and wherein, in this subsequent further game, the win is made dependent on all the game symbols then displayed in the display field, wherein in at least one winning chances display area the player is offered a display of all or of a number of winning combinations of game symbols and is given information regarding or for calculating the probabilities of winning which would realistically exist in the following game or section of the game if one or a number of the game symbols suggested as suitable for storage by the computer unit is or are stored, or if a game symbol or symbols selected for storage by the player is or are stored and/or if a combination of game symbols suggested for storage by the computer unit or selected for storage by the player is stored.

Such gaming machines may, for example, employ as game symbols the various commonly known playing card symbols or the picture symbols which are displayed on the rotary members of fruit machines. With these gaming machines, it is possible to play, for example, poker, "17 and 4" or any other kind of game in which the object is to obtain a certain number of symbols, distributed over a certain number of positions; in principle, it makes no difference whether the aim of the game is to obtain the game symbols with the highest possible values, e.g. card values or points, or whether the game symbols have to be arranged in a certain order, or whether certain combinations and/or values and/or arrangements of the various game symbols have to be obtained.

Advantageously, the game symbols presented in the display field, or a win calculation based thereon, are determined or displayed in accordance with a preestablished programmed (game plan) stored in the computer; the game symbols may be randomly selected, especially with the aid of a random symbol generator, and the wins are assigned to the selected game symbols by means of a win table stored or provided in the programmed; alternatively, it would be possible to proceed in such a way that, at the start of the game, the prize predetermined for that game is randomly chosen by means of a random generator and, corresponding to this predetermined prize, the game symbols to be displayed are determined by the computer, using a list of game symbols or on the basis of pre-established programmed data. In each case, all or a majority of the chances of winning are presented to the player in the appropriate manner, so that on the basis of this display of the chances of winning or of this plan for winning, the player can form a clear impression of the chances available to him in the next game, i,e. either from the direct display of the easily achievable wins that are likely to occur in the next game, or by performing his own calculation of his chances of winning, based on the information provided to him regarding the symbols still in play or still available to be played, or based on the information regarding the probability with which certain prizes can be won.

In the following the invention will be described in more detail, making reference, by way of example, to the drawing.

DETAILED DESCRIPTIONS OF THE PREFERRED EMBODIMENTS

Figure 1:
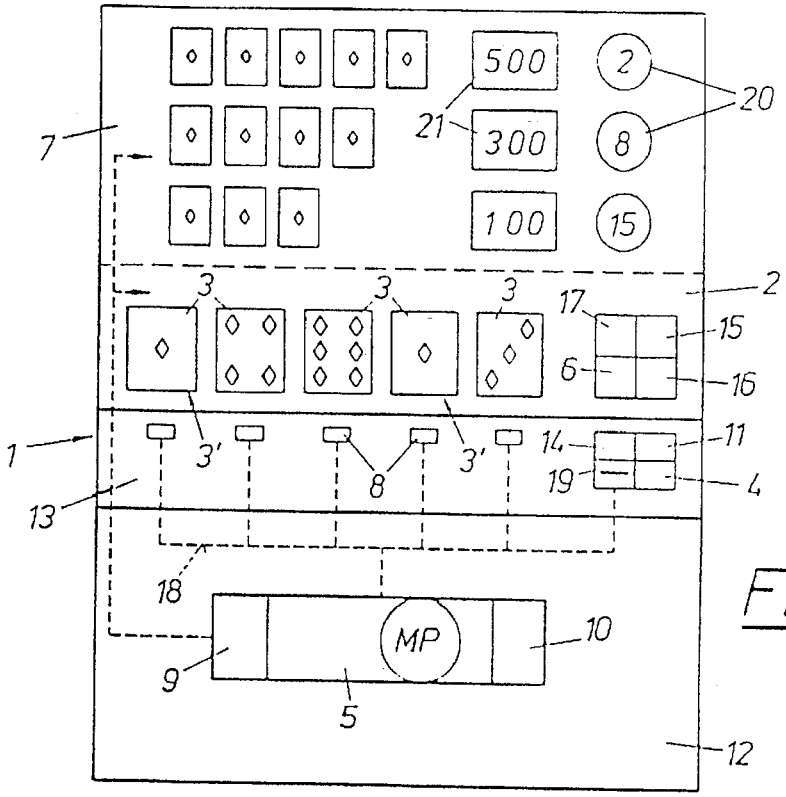
FIG. 1 shows a diagrammatic view of the structure of a gaming machine according to the invention and FIGS. 2, 3, 4 and 5 provide detailed views of an area in which the chances of winning are displayed.

A gaming machine according to the invention comprises a housing 12, here diagrammatically indicated, with the necessary facilities for playing the games; such facilities include a display field 2, an array of push buttons 13, a chances (of winning) display area 7 and a computer unit 5. It is understood that several display panels or several arrays of push buttons may be provided; in addition, further panels for the appropriate displays and for the push buttons needed to operate the gaming machine are also provided. The computer unit 5 and the units operating the display field 2 or the wires 18 connecting the push buttons 4, 8, 11 and 14 and the computer unit 5 run inside the housing 12 and are only partially shown here. The game symbols 3 selected by the computer unit 5 are displayed in the display field 2; also, at least one display 15 can be provided to show the amount of money bet, at least one display 16 to show the amount of prize money available, at least one display 6 to show the prize won in the game or portion of the game that has just taken place, and at least one display 17 showing how the prize might perhaps be doubled, etc. Below the display field 2 is arranged an array of push buttons 13 containing individual selecting means 8 of any desired design, e.g. push buttons, joysticks or knobs, assigned to the individual game symbols 3 in the display field 2, and by means of which signals can be supplied to the computer unit 5 identifying those game symbols which should be stored or held for the next game. These push buttons 8 may also be illuminated by the microprocessor 5 in order to give the player tips that he should consider storing the game symbols indicated in this manner for use in the next game. In principle, an acoustical signal may also be given to draw attention to the fact that game symbols which are potentially worth storing have been indicated.

A start button 4, a coin slot 19, a call-up button 14 and also a pay-out button 11 complete the array of push buttons 13.

Above, below or to the side of the display field 2 is arranged a winning chances display area 7 in which the computer unit 5 displays appropriate data to inform the player of his chances of winning if, for the next game, he retains certain game symbols 3' from among the game symbols 3 displayed in the display field 2 by the computer unit 5.

The computer unit 5 is connected to the display field 2 or the winning chances display area 7 by, for example, a video interface 9; normally, all the information displays are provided on a screen; it is possible to provide separate video interfaces both for the display fieid 2 and for the winning chances display area 7 if these units are formed by separate screens. The information displays 6, 15, 16, 17 and any other displays that may be needed are activated by the computer unit 5 via appropriate screens, displays, lamps or light arrays. In addition, the start button 4 and the coin slot 19 may be assigned to the computer unit 5 so that the gaming machine may be started up in the known manner.

A game played with the gaming machine according to the invention might proceed as follows:

Once the coin has been inserted into the slot, and if necessary after the player has actuated a start button 4, or after a certain amount of time has elapsed, the computer unit 5 offers the player in display field 2, for example via the appropriate video interfaces 9, five playing card symbols in the five spaces which in this case are available; in the present case an ace, a four, a six, an ace and three of diamonds are displayed. At the same time that the machine displays these game symbols 3, which are statistically or randomly selected by the computer unit 5, or after a call-up button 14 is activated by the player, the computing unit 5 indicates in the winning chances display 7 the chances of winning which are readily achievable if the player actually stores certain game symbols 3' which the computer unit 5 has judged to be advantageous for the next game. In the present case, since it is a type of poker game that is being played, the computer unit 5 has suggested that two game symbols 3', namely the two aces, should be stored and at the same time it displays the possible ways of winning the next game by obtaining five, four or three aces, and these possible ways of winning are assigned various prize values in the display fields 21. In addition to the display panels 21 indicating the amount of the attainable prizes or combinations of prizes, it is also possible to offer the player a display 20 showing the probability with which the given combinations of game symbols or the prizes are likely to be attained. For this purpose, at least one display panel 20 is arranged in the winning chances display area 7 to indicate the likelihood, expressed in percentage terms or the probability with which an indicated combination of game symbols or an offered possibility of winning can be realized.

Thus, if the player, by actuating the hold buttons 8 assigned to the two aces, confirms the suggestion that these two cards should be held and then actuates the start button 4, or if the gaming machine is appropriately set up so that the player merely has to actuate the start button 4, or if by inserting another coin or coins he continues the game, the two aces are stored for the next game or play and the computer unit 5 offers the player new game symbols only at positions 2, 3 and 5 in the next game, and these symbols may also include aces, thus to a greater or lesser extent improving the offered chances of winning.

Figure 2:
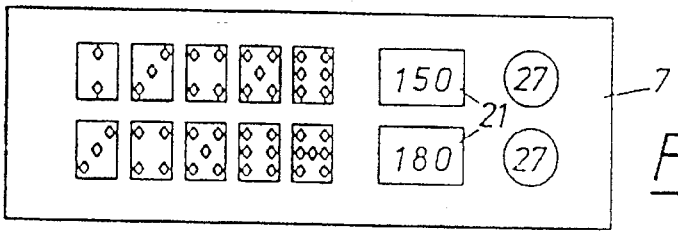

Alternatively, the player could ignore the chances of winning which have been suggested and, instead of going for a larger number of aces, could also attempt to obtain a straight flush. In this case, by actuating the corresponding hold buttons 8, the player could hold, for example, an ace, the three and the four or the three, the four and the six. In the event that the player holds the three, the four and the six, two chances of winning would be displayed, as shown in FIG. 2, in the winning chances display area 7, namely a straight flush starting with the two and ending with the six, and a straight flush beginning with the three and ending with the seven; both possibilities are attainable if the three, the four and the six are retained for the next game by appropriately actuating the hold buttons 8 assigned to these game symbols. One possible chance of winning would also be to obtain two pairs (two aces+two threes or two aces+two fours or two threes+two fours) which in principle can be displayed in accordance with the invention, but as a rule tend not to be displayed because these chances of winning are not easy to achieve and would bring in only a small win.

Advantageously, in addition to the chances offering the highest prizes, a number of chances that would also win large prizes are displayed. Which chances of winning are displayed is determined by the programmed or by the content of the respective computer memory.

Figure 3:
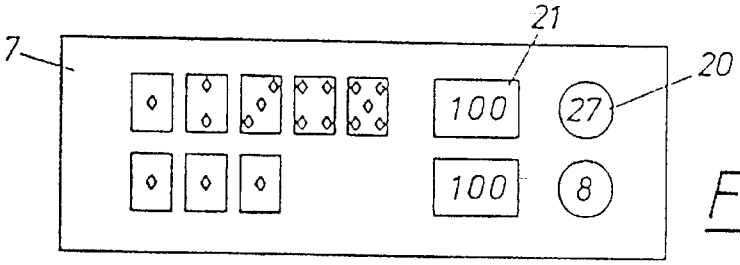

If, by actuating the hold button 8, the player retains the ace, the three and the four, then he has only one opportunity to obtain a straight flush, namely a straight flush starting with the ace and ending with the five; as is shown in FIG. 3, in this case only a single display will appear in the winning chances display 7, and also a smaller prize compared with the straight flushes shown in FIG. 2 will be displayed. The probability of obtaining one of the straight flushes, as determined by the programmed, is the same for all the possibilities and is shown in panel 20, for example, as 27%. The still available possibility of obtaining three aces is also displayed.

It should be noted that the winning chances display 7 is either always presented in combination with the game symbols offered by the computer unit 5, according to a selection of chances made by the computer unit, or this display is not presented until a button 14 is actuated to call up the chances of winning. As far as the game strategy is concerned, it is advantageous to make the display of the chances of winning dependent on which buttons 8 the player operates or which game symbols the player intends to retain. If the computer unit 5 has proposed that certain game symbols be retained. e.g. by illuminating the hold buttons 8, then the chances of winning presented in the display area are initially limited to these game symbols. Actuating just one or more buttons would, however, indicate to the computer unit 5 that the player is not going to make use of the chances of winning which have been displayed and the computer unit 5 takes the game symbol(s) marked by actuation of the corresponding hold button(s) 8 as the basis for presenting new chances of winning. It would also be possible to provide the player with cancel buttons to operate if he does not wish to accept game symbols suggested by the computer. The individual game rules or the possibilities of displaying the chances of winning as a function of times predetermined by the computer or at times desired by the player, can be variously adjusted depending on the gaming machine. However, it is important that in each case the player should be offered all or a number of feasibly achievable chances of winning.

Normally the game proceeds by requiring the player to bet a certain amount of money for the first game and, if necessary, to bet a further certain amount of money for the subsequent game or play, although in the second game or the subsequent section of the game, certain game symbols may have been predetermined by the first game.

The chances of winning are put together by the computer unit 5 in such a way that the chances of winning for specific game symbols or combinations of game symbols are entered in advance into a memory 10 allocated to the computer unit 5; at the same time, this memory 10 can also be used to prepare chances of winning or suggestions adapted to the players' customary style of play, because players often prefer to accept lower chances of winning if they are more easily achievable. It is advantageous for the computer unit to display in the winning chances display area the best possible chances of winning and/or the highest possible win that may be attained, given the game symbols which the computer has suggested be held or which the player himself has selected to be held; for this purpose, the computer reads out from a memory unit assigned to it or to the microprocessor, and then displays, the possible chances of winning or the maximum possible win achievable with certain game symbols or combinations of game symbols which are presented, or it displays the result of a calculation, if necessary using data stored in the memory unit relating to the probabilities of winning, prize information, the values of symbols or combinations of symbols, data concerning the customary choice of symbols made by the player to optimize his win or to maximize his win according to psychological and/or statistical data, etc. The display of the optimal win is complemented by a display of further opportunities of winning calculated in the same way.

The computer unit 5 comprises essentially at least one microprocessor which carries out the appropriate calculations as a function of the given parameters relating to the chances of winning.

The number of game symbols displayed in the display field 2 can be arbitrarily selected; three, four, five or more symbols may be depicted and these may have any desired shape and appearance. Similarly, the prizes assigned to the individual game symbols or combinations of symbols may be arbitrarily chosen; it should be remembered, however, that as regards the chances of winning which they offer, poker machines or fruit machines are similarly or comparably structured all around the world, so that the game rules and prizes or chances of winning offered by the gaming machine according to the invention will also be based on these known types of gaming machines. The chances of winning displayed in the present case are based on a type of poker game comprising the card symbols ace of diamonds, and the two of diamonds through to the king of diamonds, and each of these symbols exists in quintuplicate. It is also entirely possible to design a gaming machine in such a way that the given game symbols comprise a deck of cards, i.e. the suits of spades, hearts, diamonds and clubs from ace, and two to king, each card being present only singly.

It should also be mentioned that the manufacturer of the gaming machine may predetermine the probabilities of winning and the opportunities of winning, although in the game itself the game symbols or combinations of symbols are determined or displayed in a purely random manner by means of random symbol generators or similar devices. Predetermined settings are chosen in particular in order to increase the player's pleasure in playing by increasing the wins. Appropriate reprogramming of the computer unit 5 can be carried out by exchanging the memories 10 or by programming in appropriately modified game parameters.

Figure 4:
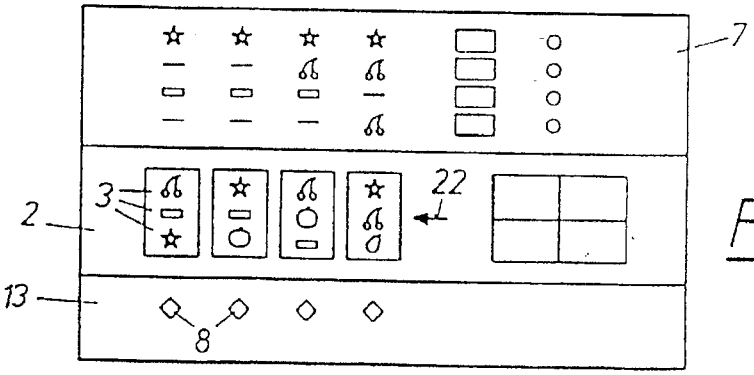

FIG. 4 describes an embodiment of a gaming machine known as a "fruit machine".

In display field 2 the player is presented with a number of game symbols, in the present case cherries, apples, pears, bars and stars, which occur alongside each other in various display areas, in the present case in four display areas. The computer unit 5 determines which symbols will be displayed and in each display area one, two, three or even more such game symbols are presented; in the present case, as is usual in fruit machines, three game symbols 3 are simultaneously presented in each display area. A win is made dependent on the appearance of game symbols at the respective display positions (top, middle, bottom). This is made clear by the winning chances display 7 shown in FIG. 4

A win with the star symbols is possible only if a star appears at any point within each of the adjacent display areas; this explains the chance of winning shown for the four stars displayed.

Two cherries win when they appear in the two right-hand display areas, in the middle, which is indicated by the arrow 22. One cherry wins when it appears on the far right of the display. Three bars win when they appear in the three left-hand display areas, in the middle, which is indicated by the arrow 22. Thus, in the present case the four most realistic chances of winning are indicated which would be achievable if the first, second and fourth game symbols were to be held. The player, by activating the button 8 assigned to the display area with the apple, may indicate that he wishes to retain this (these) game symbol(s) (i.e. also the star at the top and below it the bar) and does not wish to retain the game symbols which are suggested by the machine; only then is the chance of winning associated with this choice of symbols displayed; since the chance of winning in this case is very small, the machine may have been programmed not to display any chance of winning. Chances of winning which are very unlikely to occur and which are not related to the game symbol(s) selected are as a rule not displayed; i.e. a plurality of realistic chances of winning, but in principle not all chances of winning, are shown.

A further possibility, which may be alternatively or jointly provided in such gaming machines will now be explained on the basis of FIG. 5.

It is possible, from game to game or for a certain number of games, to predetermine the number and/or type of game symbols generated by the computer or by the programmed, or a certain predetermined number of game symbols, varying from case to case, can be added at certain intervals.

From the total number of game symbols which are available for a game and from the number of individual symbols or from the indication how often an individual game symbol is present, the player can himself to a certain extent estimate the chances of a symbol being displayed in the next game or the next play; the more often such a game symbol is present, the greater is the probability of that symbol appearing in the next game or play. If, therefore, the player is given suggestions by the computer as to which symbols to retain, the player needs to know whether these suggestions are based on the game symbols originally present or whether they were made on the basis of the number and type of symbols predetermined for the next game. Depending on whichever is the case, the player can judge which game symbols he should keep for a subsequent game, if he wants to keep any at all, or he can decide to have a perhaps already displayed prize paid out to him, or he may not want to continue playing at all by adding a new game or a new play.

Figure 5:
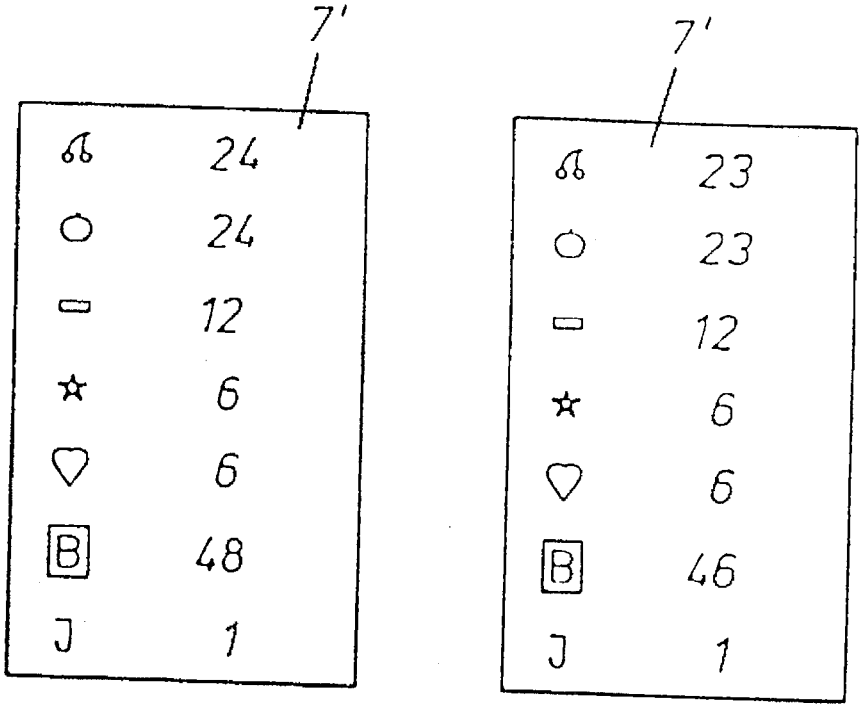

At the player's request or because of a repeatedly appearing display, the player—as shown in FIG. 5, left—is presented, in a winning chances display panel 7', with an initial display of the game symbols available at the start of the game.

Thus, at the start of the game, 24 cherries, 24 apples, 12 bars, 6 stars 6 hearts, 48 blanks and 1 joker are available. Assuming that the game symbols are presented at four positions in display field 2, as was the case in the preceding game as per FIG. 4, and assuming that a cherry, two blanks and an apple were presented in a completed first game, then the display depicted in winning chances display area 7' on the right-hand side of FIG. 5, namely 23 cherries, 23 apples, 12 bars, 6 stars, 6 hearts, 46 blanks and 1 joker would be available for the next game. Thus, from game to game the symbols offered to the player would be deducted from the originally existing symbols, if some symbols appeared or were displayed more frequently; the other symbols are therefore left over and occur in greater numbers in the following games so that the player can adjust his game accordingly.

In order to ensure that an adequate number of game symbols is available at all times, provision can be made that after a certain number of games or after certain game symbols have appeared, the number of available game symbols can be added to in a random or predetermined fashion; this addition of game symbols or the game symbols available after the addition has been made can in turn be displayed in the winning chances display area 7'.

The chances of winning in each case can be indicated on areas of the screen separate from the display field 2; it is entirely possible for the winning chances display to replace the display field 2, especially when screen displays are used, so that game symbols or the chances of winning are displayed one after the other at the same place. The display area may be a video screen, a display, an LED display, or a window behind which rotary elements or film strips, or similar, move past; in the display area, the game symbols are presented to the observer in any known manner at predetermined places.

It should be noted that in each game sequence the game symbols are selected by the computer in a way that cannot be influenced at all by the player; the selection is made either on the basis of a randomizing strategy or by implementing a programmed which determines the win situations. Stop buttons which may be actuated by the player serve merely to fix the time when the game symbols are selected by the computer, but they do not provide any true chance of actually selecting the game symbol which is offered according to random criteria.

It goes without saying that the computer or the gaming machine contains appropriate devices, especially computing units, which determine the game symbols to be displayed and which display or pay out a win as a function of the wins scored by the player. The achievable winning combinations allocated to a certain combination of game symbols, i.e. by adding a number of other game symbols, are either recalculated from game to game, based on corresponding memory data, or they are determined and stored in advance in memories for certain game combinations and need only to be withdrawn from memory. At any event, appropriate switching and control units exist which display some or all of the winning combinations which are possible in the next game, in order to provide the player with the appropriate strategy-forming information. Thus, in addition to displaying the maximum possible win, other possibilities of winning are displayed either jointly, i,e. in a block together with the maximum win, or also separately from the maximum win, in their own display area. This possible display differs in principle from the fixed lists of all the possible winning combinations which are presented on various gaming machines, because the information offered to the player in the gaming machines according to the invention is always dependent on the game symbols actually appearing in the display field 2 or on the game symbols which have been held over from a previous game, so that the relevant information needed by the player is available in the shortest possible time.

In addition, it should be noted that the nudging function may also be provided in the fruit machines according to the invention as an additional feature of the method of playing according to the invention, i.e. after the selection procedure has been completed or the game symbols have been identified which will be retained for the next game or section of the game, and once this next game or section of the game has been played, the displayed card symbols or fruit machine symbols can be subsequently modified by "nudging" in order to improve the win situation.

What is claimed:

1. A gaming machine comprising (a) a computer including a micro processor;

(b) a first display connected to the computer for displaying a plurality of randomly selected computer-generated gaming symbols upon starting the game by initiating a starter, a first control for paying out possible winnings, a second control for calling-up additional computer generated gaming symbols, a plurality of selecting devices associated to each of the plurality of randomly selected computer-generated gaming symbols for one of immediately selecting, storing and selecting later each of the plurality of randomly selected computer-generated gaming symbols;

a first indicator for indicating a total winning amount, a second indicator for indicting an available winning amount at any time during the game, a third indicator for indicating an amount won in a previous game, a fourth indicator for providing advice as to how to double a winning amount;

(c) a second display for displaying a game-specific combination of gaming symbols selected from the first display by pressing one of the plurality of selecting devices associated to each of the plurality of the randomly selected computer-generated gaming symbols and the computer-generated gaming symbols called up by the second control of the first display area and including a price value display for displaying a price value of the game-specific combination of gaming symbols selected in the second display, and further including a probability display for indicating winning chances of the game-specific combination of gaming symbols displayed in the second display.

2. The gaming machine according to claim 1, further comprising at least one of acoustical and optical indicators for indicating win-related preference for selecting or storing of gaming symbols.

3. The gaming machine according to claim 2, wherein the probability display is accomplished by displaying possible win-related combinations of game symbols.

4. The gaming machine according to claim 1, wherein the game symbols identified as representing possible win-related are illuminated.

5. The gaming machine according to claim 4, wherein the win-related combinations of game symbols are displayed when advantageous for selection by the player.

6. The gaming machine according to claim 4, wherein the game symbols are fruit symbols.

7. The gaming machine according to claim 1, wherein the second display is a video display screen.

8. The gaming machine according to claim 1, wherein the game symbols are identical to card of card games.

9. A method for playing with a gaming machine comprising the steps of starting the gaming machine to display randomly selected computer generated gaming symbols;

selecting from a plurality of randomly selected computer generated gaming symbol such gaming symbols which are favorable for winning;

selecting at least one of the steps of storing non-selected gaming symbols from the plurality of randomly selected computer generated gaming symbols for a later use and calling up new randomly selected computer generated gaming symbols;

observing during the selection steps a display indicating a probability of winning which is associated to each gaming symbol selected.

10. The method for playing with a gaming machine according to claim 9, further comprising the step of observing during the selection step the price value of winning.

11. The method for playing with a gaming machine according to claim 9, further comprising the step of enhancing acoustically the selection steps when win-related preferences are selected.

12. The method for playing with a gaming machine according to claim 9, further comprising the step of enhancing optically the selection steps when win-related preferences are selected.

13. A game machine comprising (a) a computer including a microprocessor;

(b) a first display connected to the computer for displaying a plurality of randomly selected computer-generated gaming symbols upon starting a game by initiating a starter, a plurality of selecting devices, each selecting device being associated to one of the plurality of randomly selected computer-generated gaming symbols for immediately selecting and storing for later use of at least one of the plurality of randomly selected computer-generated gaming symbols, a control for calling-up and displaying in the first display additional randomly selected computer-generated gaming symbols by replacing not selected and not stored gaming symbols;

(c) a resulting combination being determined by game-specific combinations including the gaming symbols stored by an actuated one of the plurality of selecting devices associated with the plurality of the randomly selected computer-generated gaming symbols and by the computer-generated gaming symbols called up by said control;

(d) a second display for displaying one of at least one attainable winning combination based on and attainable with the game-specific combinations of gaming symbols selected and stored by the actuated selecting devices, and displaying winning probabilities of at least one attainable winning combination based on the game-specific game combinations of gaming symbols selected and stored by the actuated selecting devices; and (e) a third display for indicating the winning combination resulting in a maximum winning amount.

14. A method for playing with a gaming machine comprising the steps of:

starting the gaming machine to display randomly selected computer generated gaming symbols;

selecting from a plurality of randomly selected computer-generated gaming symbols such gaming symbols which are favorable for winning as a game-specific combination;

replacing non-selected gaming symbols from the plurality of randomly selected computer-generated gaming symbols by calling up new randomly selected computer-generated gaming symbols for configuring a possible winning combination; and observing during the selecting step and before the replacing step a display indicating at least one attainable winning combination based on one of the game specific combinations and a probability of winning which is associated to at least one game-specific combination of gaming symbols selected and stored.

* * * * *